US005359354A

United States Patent [19]

Hiraishi et al.

[11] Patent Number: 5,359,354

[45] Date of Patent: Oct. 25, 1994

[54] INK JET HEAD WITH DUMMY SLOTS

[75] Inventors: Hisato Hiraishi; Fumio Maeno; Motonobu Hoshino; Yoshihiko Yanagawa; Keisuke Kigawa, all of Saitama, Japan

[73] Assignee: Citizen Watch Co., Ltd., Tokyo, Japan

[21] Appl. No.: 790,751

[22] Filed: Nov. 12, 1991

[30] Foreign Application Priority Data

Nov. 9, 1990 [JP] Japan ..... 2-302720
Jan. 14, 1991 [JP] Japan ..... 3-016053

[51] Int. Cl.[5] ..... B41J 2/045; B41J 2/055
[52] U.S. Cl. ..... 347/69; 347/94
[58] Field of Search ..... 346/140 R; B41J 2/045, B41J 2/055

[56] References Cited

U.S. PATENT DOCUMENTS

| | | | |
|---|---|---|---|
| 4,390,886 | 6/1983 | Sultan | 346/140 R |
| 4,550,326 | 10/1985 | Allen et al. | 346/140 R |
| 4,740,800 | 4/1988 | Kyoshima | 346/140 R |
| 4,887,100 | 12/1989 | Michaelis et al. | 346/140 R |
| 5,016,028 | 5/1991 | Temple | 346/140 R |

FOREIGN PATENT DOCUMENTS

| | | |
|---|---|---|
| 0012138 | 2/1978 | Japan . |
| 0059914 | 3/1986 | Japan . |
| 0252750 | 10/1988 | Japan . |

*Primary Examiner*—Benjamin R. Fuller
*Assistant Examiner*—Alrick Bobb
*Attorney, Agent, or Firm*—Wenderoth, Lind & Ponack

[57] ABSTRACT

An ink jet head is disclosed for use with a drop-on demand type printer, and includes an insulating base, a plurality of elongated barriers projecting upwardly from the base so as to form a plurality of slots between the barriers, a plurality of nozzle holes communicating with the slots, and electrodes formed on the side walls of the elongated barriers. Voltage can be applied to the various barriers through the electrodes in order to cause deflection of the barriers and a corresponding reduction in the cross-sectional area of selected slots, so as to force ink contained in the slots to be jetted through the nozzle holes. In order to provide a uniform ink jet intensity from the outermost slots relative to the inner slots, dummy slots can be formed outwardly of the outermost active slots by providing dummy barriers outwardly of the outermost active barriers. In addition, the nozzle holes are formed in a nozzle plate. The nozzle plate can either be mounted against the ends of the slots, or atop the base. When mounted atop the base, possible breakage of the ends of the barriers is less of a problem. Further, the plurality of barriers can either be mounted to the base by an adhesive, or can be formed integrally with the base. Also, the ink jet head can be formed with two bases, one atop the other, with the barriers of the bases being polarized in opposite directions.

20 Claims, 12 Drawing Sheets

INK JET HEAD WITH DUMMY SLOTS

BACKGROUND OF THE INVENTION

1. Field of the Invention

The present invention relates to an ink jet printer head for a drop-on demand (DOD) type printer.

2. Description of the Prior Art

Among non-impact type printers, ink jet printers have recently become quite popular, due, in large part, to the fact that they operate on a relatively simple principle and are suitable for use in color printing. Of the non-impact type printers, continuous ink jet type printers were first developed, with DOD type printers being more recently developed. Such DOD type printers do not continuously jet ink, but rather jet ink only when it is necessary to form a dot. Currently, these DOD type printers are more popular than the continuous ink jet type printers.

A typical DOD type printer is a kizer type printer such as that disclosed in Japanese patent publication No. 12138/1978. However, such kizer DOD type printers are burdened by the fact that they are quite difficult to miniaturize.

Another typical DOD type printer is a thermal jet type such as that disclosed in Japanese patent publication No. 59914/1986. However, such thermal jet type printers are burdened by the fact that the ink used therein must be heated to a relatively high temperature, thus resulting in burning and sticking of the ink.

Accordingly, as disclosed in Japanese patent laid-open No. 252750/1988, a shear mode type DOD printer has been developed in order to overcome the above-noted problems confronting these typical DOD type printers. The construction and principles of operation of this shear mode type printer will now be described with reference to FIGS. 7–10 and 18.

As best shown in FIGS. 9(*a*) and 9(*b*), a plurality of elongated barriers 95*ab*, 95*bc*, and 95*cd* are bonded onto a base 105 by an adhesion layer 108 in such a manner as to form narrow slots 92*a*, 92*b*, and 92*c* which define ink chambers and flow paths. The ink for these narrow slots 92*a*, 92*b* and 92*c* is to be supplied from a common ink reservoir 187 defined at first ends of the slots 92*a*, 92*b* and 92*c* so as to be in communication, as best seen in FIGS. 10 and 18, with the narrow slots.

Second ends of the slots 95 are substantially closed by a nozzle plate 100 bonded to the ends of the barriers 95. The nozzle plate 100 has a plurality of small nozzle holes 93*a*–93*f* formed therein in communication with each of the slots 92*a*–92*f*, respectively.

A lid 106 is bonded to upper surfaces of the barriers 95 by a flexible elastic material 109 in such a manner that the barriers 95 are flexible in lateral directions relative to the lid 106 (see FIG. 9(*b*)).

The base 105 is to have electrical insulation characteristics by being formed, for example, of glass or ceramics. The lid 106 is also formed of glass or ceramics in order to provide it with electrical insulation characteristics. The barriers 95, however, are formed of piezoelectric material such as titanic acid zirconic lead (PZT).

Again referring to FIGS. 7, 9(*a*) and 9(*b*), electrodes 94*a*2–94*f*1 are mounted along the entirety of each of the side walls of the plurality of barriers 95*ab*–95*ef*. Each of the barriers 95*ab*–95*ef* is polarized in a like direction as shown by arrows 107 (or in a direction opposite thereto).

Accordingly, when a sufficiently large electric potential is induced across the electrodes 94*a*2 and 94*b*1, the barrier 95*ab* is forced to deflect in the manner shown in FIG. 9(*b*). As shown, because the elastic material 109 is more flexible than the adhesion layer 108, the deflection of the barrier 95*ab* mainly occurs at the upper portion thereof nearest the lid 106. In a like manner, when a sufficiently large electric potential is provided to the electrodes 94*b*1 and 94*b*2 (the electrodes 94*b*1 and 94*b*2 are normally of the same electric potential), the barrier 95*bc* is caused to deflect in the manner shown in FIG. 9(*b*). Such deflection of the barriers 95*ab* and 95*bc* causes a reduction in the cross-sectional area of the slot 92*b* (and thus in the volume thereof), such that ink contained in the slot 92*b* is forced outwardly through the nozzle hole 93*b*.

Thus, by selectively causing deflections of the various barriers in the above-noted manner, ink drops can be forced out (or jetted) from the selected nozzle holes 93*a*–93*f*.

With this type of arrangement, the slots 92*a*–92*f* may be formed narrowly so as to allow for miniaturization, and it is also unnecessary to utilize high temperatures as in the kizer type printer discussed above. Accordingly, the ink jet head disclosed in the Japanese patent application laid-open No. 252570/1988, the problems noted above in connection with DOD type printer heads of Japanese publication 12138/1978 and 59914/1986, have been obviated. However, this ink jet head disclosed in Japanese patent application laid-open No. 252750/1988 is still beset with various shortcomings.

More specifically, the reduction in cross section of each of the four slots 92*b*–92*e* is effected by deflection of the two barriers between which the particular slot is defined. However, this is not the case with respect to the two outermost slots 92*a* and 92*f*, the cross-sectional area of the slot 92*a*, for example, being effected by only the deflection of the barrier 95*ab*, and not by deflection of a second barrier. Therefore, if, when the cross-sectional area of the slot 92*a* is to be reduced in order to force an ink drop from the nozzle hole 93*a*, the barrier 95*ab* is caused to deflect toward the slot 92*a* by the same amount as each of the barriers 95*ab* and 95*bc* would be deflected toward the slot 92*b* in order to force an ink drop through the nozzle hole 93*b*, the force which will act upon the ink contained in the slot 92*a* will be less than that for the slot 92*b*. This can, in extreme cases, cause no ink to be discharged and, in other cases, can cause the dot created by the ink drop to be of a smaller or irregular size relative to dots produced from the nozzle holes 93*b*–93*e*. This results in poor printing quality due to the occurrence of missing ink dots and irregular ink dot sizes.

The reduction in the force acting on the ink in the slot 92*a* (or 92*f*) relative to that which acts on ink in the slots 92*b*–92*e*, can be somewhat obviated by applying different voltages to the outermost barriers 95*ab* and 95*ef* than is applied to the other barriers 95*bc*–95*de*. This variance in the voltage is applied as illustrated in FIG. 8, in which the vertical axis represents voltage and the horizontal axis represents time. The wave forms 81–86 in FIG. 8 represent different voltages applied to the barriers 95*ab*, 95*bc* and 95*cd*, respectively, at different times, and the lines 87, 88 and 89 represent zero voltage levels for the barriers 95*ab*, 95*bc* and 95*cd*, respectively.

As clearly illustrated in FIG. 8, the voltage applied to each barrier is opposite in polarity to that applied to its neighboring barrier, in order to cause the barriers to deflect toward or away from one another. The wave forms 81–86 also illustrate that application of voltage to the barriers is substantially instantaneous, whereas the removal of voltage from the barriers is relatively gradual. This is necessary so that the barriers are moved rapidly for the purpose of jetting ink, but moved more gradually in terminating the jetting of the ink. The wave forms 81–86 are thus shaped non-symmetrically in order to illustrate this manner of applying and removing the voltage from the barriers.

As further illustrated in FIG. 8, the magnitude of the voltage applied to the barrier 95*ab* to cause jetting of ink from the nozzle hole 93*a* is approximately double the magnitude of the voltage applied to each of the barriers 95*ab* and 95*bc* when it is desired to cause ink to be jetted from the nozzle hole 93*b*. This will increase the deflection of the barrier 95*ab* during jetting of ink from the nozzle hole 93*a* relative to the deflection of the two barriers 95*ab* and 95*bc* during jetting of ink from the nozzle hole 93*b* (in this regard, compare wave form 82 applied during jetting of ink from the nozzle hole 93*a* to the wave forms 81 and 83 illustrating the voltage applied during jetting of ink from the nozzle hole 93*b*).

With this application of a higher magnitude of voltage to the outermost barriers during jetting of ink from the outermost nozzle holes, the above-noted reduction in the ink jetting force from the nozzle holes 93*a* and 93*f* is at least partially obviated. However, this solution to the one problem results in additional problems as follows:

(1) Because the application of the higher voltage (as illustrated by wave form 82) causes a relatively greater deflection of the barrier 95*ab*, when ink is being jetted from the nozzle hole 93*a*, the cross-sectional area of the neighboring slot 92*b* is markedly increased, thus causing a substantial reduction in the pressure in the slot 92*b*. This reduction in pressure results in the formation of air bubbles in the ink contained in the slot 92*b*, thereby resulting in irregular jetting of ink from the nozzle hole 93*b*;

(2) Because the deflection of the barrier 95*ab* in forcing ink to be jetted from the nozzle 93*a* is relatively large, the return of the barrier 95*ab* to its normal rest position causes a relatively large volume reduction in the slot 92*b*, thereby often resulting in ink being improperly jetted from the nozzle hole 93*b*; and (3) The non-symmetrical shape of the voltage wave forms 81 and 82, along with the large magnitude of the voltage of wave form 82, often results in the polarization of the barrier 95*ab* in the direction of the electrode 94*b*1 and away from the electrode 94*a*2. This polarization results in the reduction of deflecting force for the barrier 95*ab*.

In addition to the problems created by the fact that the outermost slots 92*a* and 92*f* are defined by only one barrier each, the shearing mode type ink jet printer head disclosed in Japanese patent application laid-open No. 252750/1988 is also beset with a problem which will now be described with particular reference to FIG. 18.

As shown in FIG. 18, the slots 92*a*–92*f* are substantially closed at ends thereof by the nozzle plate 100 having the nozzle holes 93 formed therein. During the manufacturing of the ink jet head, the placement and subsequent bonding of the nozzle plate 100 to the ends of the barriers 95 often results in the breakage of the end portions of the barriers 95, especially in view of the fact that the barriers 95 are formed of a piezoelectric material which is relatively brittle, and the fact that the barriers 95 are normally formed with a width of less than 100 μm. Such breakage of the barriers 95 results in ink flowing between adjoining slots 92, such that deflection of a barrier for the purpose of jetting ink from one nozzle hole 93 may cause a rise in pressure in adjoining slots. In addition, such possible ink flow between the adjoining slots can result in the loss of pressure in a slot.

SUMMARY OF THE INVENTION

Accordingly, a first object of the present invention is to overcome the above-noted problems of the conventional print head created by the provision of slots from which ink is to be jetted which are bounded by only one deflectable barrier.

This object can be achieved according to the present invention by providing a shearing mode ink jet head comprising: a base having an upper surface; a plurality of elongated barriers projecting upwardly from said upper surface of said base in such a manner as to form a plurality of elongated active slots along said upper surface of said base between adjacent ones of said elongated barriers, said plurality of active slots including one outermost active slot on each side of said plurality of active slots, and so as to form a dummy slot outside of each of said outermost active slots; a common ink reservoir in communication with each of said active slots; means, comprising electrodes mounted on opposing side walls of each of said elongated barriers which defines a side wall of one of said active slots, for selectively applying voltage to particular ones of said barriers and causing lateral displacement of said particular ones of said barriers, in order to compress ink contained in the ones of said active slots formed between said particular ones of said barriers; and means, comprising nozzle holes communicating respectively with said active slots, for controllably dispensing ink contained in said active slots formed between said particular ones of said barriers when said voltage applying means operates to compress the ink contained in said ones of said active slots formed between said particular ones of said barriers, said dummy slots being devoid of nozzle holes so as to prevent ink from being dispensed from said dummy slots.

A second object of the present invention is to overcome the above-noted problem of the conventional print head wherein the ends of the barriers are often damaged during the manufacturing process.

This object can be achieved according to the present invention by providing an ink jet head comprising: a base having an upper surface; a plurality of elongated barriers projecting upwardly from said upper surface of said base in such a manner as to form a plurality of slots along said upper surface of said base between adjacent ones of said elongated barriers; a common ink reservoir in communication with each of said slots.; means, comprising electrodes mounted on opposing side walls of each of said elongated barriers, for selectively applying voltage to particular ones of said barriers and causing lateral displacement of said particular ones of said barriers, in order to compress ink contained in the ones of said slots formed between said particular ones of said barriers; means, comprising nozzle holes communicating respectively with said slots, for controllably dispensing ink contained in said slots when said voltage applying means operates to compress the ink contained in said ones of said slots formed between said particular ones of said barriers; and a lid mounted to said base above said barriers, said nozzle holes being formed in said lid in alignment with said slots, respectively.

It should be noted that the various improvements of the present invention for overcoming the shortcomings of the conventional ink jet heads, while being referred to in the present application as separate improvements, can be utilized together in a single apparatus.

An alternative arrangement for achieving objects of the present invention is attained by providing an ink jet head comprising: a lower base having an upper surface; a plurality of elongated lower barriers having upper surfaces and projecting upwardly from said upper surface of said lower base in such a manner as to form a plurality of elongated lower slots along said upper surface of said lower base between adjacent ones of said elongated lower barriers; an upper base having a lower surface; a plurality of elongated upper barriers having lower surfaces and projecting downwardly from said lower surface of said upper base in such a manner as to form a plurality of elongated upper slots along said lower surface of said upper base between adjacent ones of said elongated upper barriers, said lower surfaces of said upper barriers being mounted in abutment with said upper surfaces of said lower barriers, respectively, such that said upper and lower slots together form a plurality of elongated ink slots formed between said upper base and said lower base, and said upper and lower barriers together form a plurality of elongated ink barriers; means, comprising electrodes mounted on opposing side walls of each of said elongated ink barriers, for selectively applying voltage to particular ones of said ink barriers and causing lateral displacement of said particular ones of said ink barriers, in order to compress ink contained in the ones of said ink slots formed between said particular ones of said ink barriers; and means, comprising nozzle holes communicating respectively with said ink slots, for controllably dispensing ink contained in said ink slots formed between said particular ones of said ink barriers when said voltage applying means operates to compress the ink contained in said ones of said ink slots formed between said particular ones of said ink barriers.

BRIEF DESCRIPTION OF THE DRAWINGS

Additional objects and advantages of the present invention will become apparent from the following detailed description of the invention when read with reference to the accompanying drawing figures, in which:

FIG. 9(*b*) is a view similar to FIG. 9(*a*), but with the ink jet head in an activated state;

DETAILED DESCRIPTION OF THE INVENTION

Figure 1:
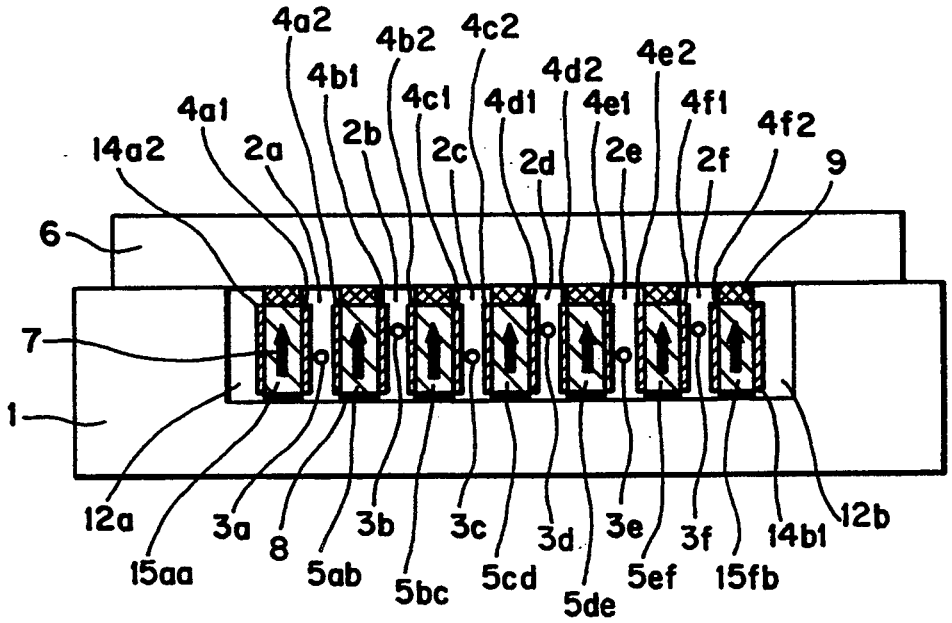
FIG. 1 is a sectional view of a shearing mode type ink jet head according to a first embodiment of the present invention.

A cross section of a first embodiment of the present invention is shown in FIG. 1. The construction of this first embodiment is essentially the same as the construction of the prior art ink jet head shown in FIG. 7, with the exception that the ink jet head of this first embodiment shown in FIG. 1 includes dummy barriers 15*aa* and 15*fb* disposed outwardly of the barriers 5*ab*–5*ef*, and except that dummy slots 12*a* and 12*b* are formed outwardly of the dummy barriers 15*aa* and 15*fb*, respectively.

Figure 18:
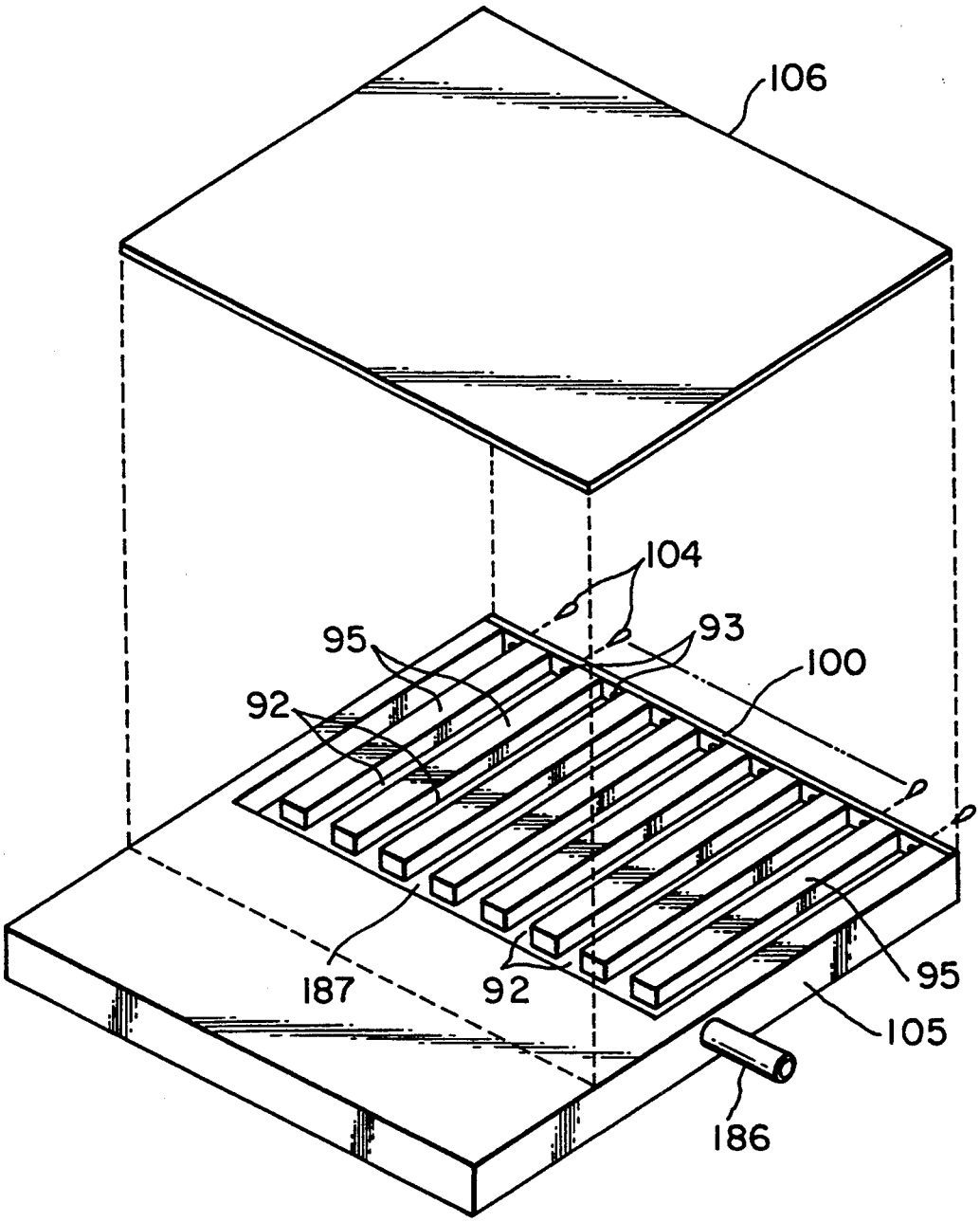
FIG. 18 PRIOR ART
FIG. 18 is a perspective view of the conventional print head shown in FIG. 7.

More specifically, the ink jet head shown in FIG. 1 includes a base 1 formed of an insulating material such as glass or ceramics, and preferably alumina, and a plurality of active barriers 5*ab*, 5*bc*, 5*cd*, 5*de* and 5*ef* bonded to the insulating base 1 by an adhesive layer 8. The barriers 5*ab*–*ef* are formed in parallel with one another and are spaced apart at equal intervals so as to form elongated narrow slots 2*a*–2*f* therebetween which define ink chambers and ink flow paths. The active slots 2*a*–2*f* are connected at first ends thereof to a common ink reservoir (not shown in FIG. 1, but similar to the common ink reservoir 187 shown in prior art FIG. 18), and are substantially closed at respective second ends thereof, except that nozzle holes 3*a*–3*f* are provided. In addition, a lid 6, formed of glass or ceramics, is mounted atop the base 1, and is bonded to the upper surfaces of the active barriers 5*ab*–5*ef* by a flexible elastic material 9.

Figure 7:
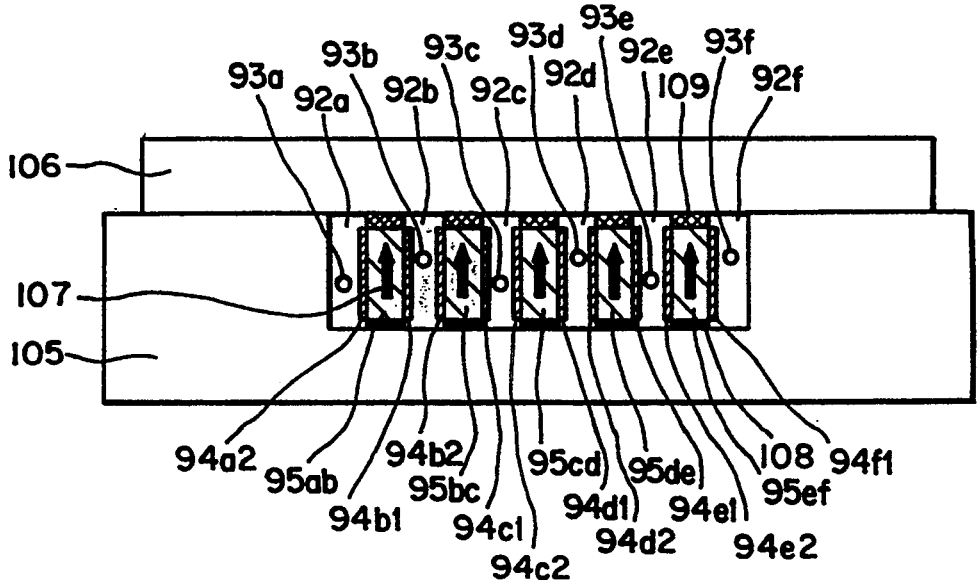
FIG. 7 PRIOR ART
FIG. 7 is a sectional view of conventional shearing mode type ink jet head.

Active electrodes 4*a*2–4*f*1 are mounted on side walls of the active barriers 5*ab*–5*ef*, respectively, as in the prior art ink jet head shown in FIG. 7. In addition, the dummy barriers 15*aa* and 15*fb* are included and project upwardly from an upper surface of the base 1. These dummy barriers 15*aa* and 15*fb* are disposed outwardly of the outwardmost active barriers 5*ab* and 5*ef*, respectively, and are spaced apart from the outwardmost active barriers 5*ab* and 5*ef*, respectively, by intervals equal to those at which the active barriers are spaced.

Outwardly of these dummy barriers 15*aa* and 15*fb* are formed dummy slots 12*a* and 12*b*, respectively. Dummy electrodes 4*a*1, 14*a*2, 4*f*2 and 14*b*1 are mounted on the side walls of the dummy barriers 15*aa* and 15*fb*, respectively. Note that the term "dummy" does not necessarily indicate that the electrodes 4*a*1, 14*a*2, 4*f*2 and 14*b*1 are not active in the sense that voltage can not be applied thereto. As with the active slots 2*a*–2*f*, the ends of the dummy slots are connected to a common ink reservoir. However, ends of the dummy slots 12*a*, 12*b* opposite the ends connected to the ink reservoir do not have nozzle holes formed therein. Although no nozzle holes are formed in the ends of the dummy slots 12*a*, 12*b* other small holes can be formed and freely positioned, in order to allow venting of the dummy slots to facilitate filling thereof with ink from the ink reservoir, so long as the small holes are sufficiently small to prevent ink from being jetted therefrom. Furthermore, although the nozzle holes 3*a*–3*f* must be located in a limited manner as disclosed in Japanese patent application laid-open No. 252750/1988, no such restriction is placed on the location of the dummy slots 12*a*, 12*b*.

The active barriers 5*ab*–5*ef* and the two dummy barriers 15*aa* and 15*fb* are preferably formed of PZT and are polarized in like directions as shown by arrow 7 (or in opposite directions thereto). In addition, the adhesive layer 8 between the alumina insulating base 1 and the PZT barriers is preferably formed of epoxy resin. Each of the slots 2*a*–2*f* is preferably approximately 100 μm wide and 150 μm deep, and the electrodes 4*a*2–4*f*1, as well as the dummy electrodes 14*a*2, 4*a*1, 4*f*2 and 14*b*1, are preferably formed of laminated film formed by metalizing chromium and gold and are preferably approximately 0.8 μm in thickness.

The lid 6 is preferably formed of alumina plate, and is bonded to the barriers by the elastic material 9, which is preferably formed of silicone resin. The nozzle holes 3*a*–3*f* are preferably circular and have diameters of approximately 35 μm and are preferably formed by etching in the nozzle plate which is preferably formed of stainless steel.

Figure 2:
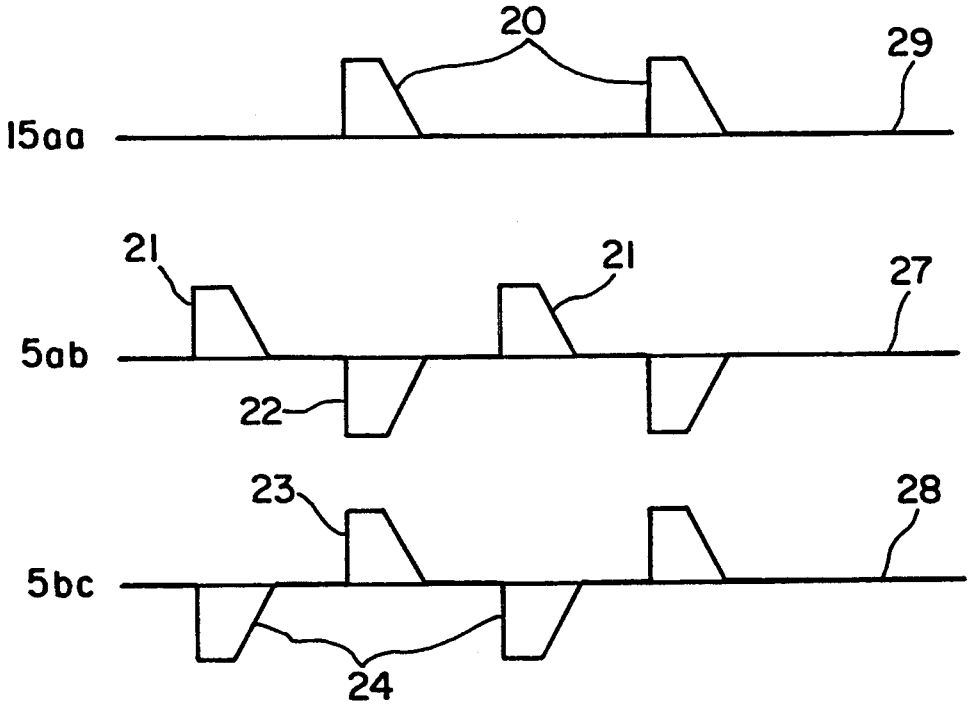
FIG. 2 is a graph illustrating transient wave forms of voltage applied to the shearing mode type ink jet head of FIG. 1.
Figure 8:
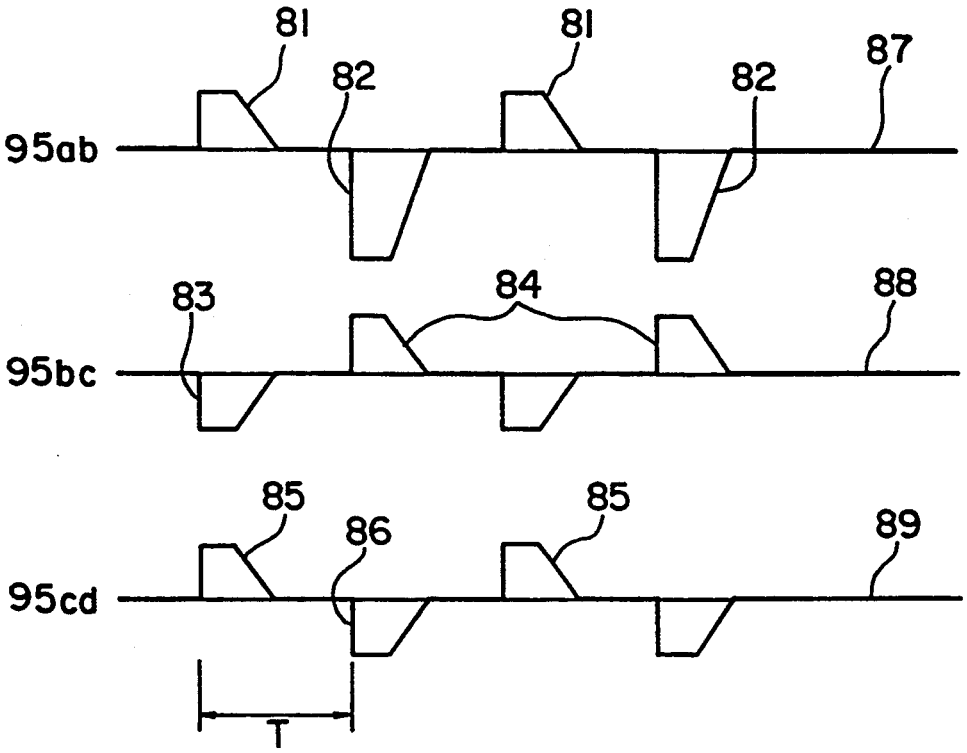
FIG. 8 PRIOR ART
FIG. 8 is a graph illustrating transient wave forms of voltage which can be applied to the conventional shearing mode type ink jet head of FIG. 7.

FIG. 2 is a graph similar to FIG. 8, except showing wave forms of the voltage to be applied to the dummy barrier 15*aa*, and the active barriers 5*ab* and 5*bc* of the first embodiment shown in FIG. 1. The straight lines 29, 27 and 28 represent zero voltage levels for the dummy barrier 15*aa*, and the active barriers 5*ab*, 5*bc*. Note the marked difference between the wave forms for the active barrier 5*ab* as shown in FIG. 2, and the wave forms for the barrier 95*ab* shown in FIG. 8. That is, with the inclusion of the dummy barriers, dummy slots and dummy electrodes in the embodiment of FIG. 1, it is unnecessary to apply a larger magnitude of voltage (as at 82) to the outermost active barrier 5*ab* (see wave form 22) as compared to the magnitude of voltage applied to the remaining barriers, to obtain the same amount of reduction in cross section in the outermost active slot 2*a* as is obtained for the remainder of the inner active slots. That is, when the voltage is applied to the dummy barrier 15*aa* in accordance with the wave form 20, the reduction in cross section of the slot 2*a* is equal to that for the slots 2*b*–2*e* upon applying equal voltage magnitudes to the remainder of the barriers. Because the dummy slot 12*a* is not utilized for the purpose of compressing ink and jetting it from a nozzle, it is unnecessary to cause deflection of the dummy barrier 15*aa* toward the slot 12*a*, and thus it is unnecessary to apply a voltage to the dummy barrier 15*aa* which is of an opposite plurality to that depicted by the wave forms 20.

Although the operating principles of this embodiment shown in FIG. 1 have been described with respect to only the left side of FIG. 1 (i.e. with respect to dummy slot 12*a* and dummy barrier 15*aa*), it is apparent that the same principles are to be applied to the right side of FIG. 1 (i.e. to dummy slot 12*b* and dummy barrier 15*fb*).

Figure 9A:
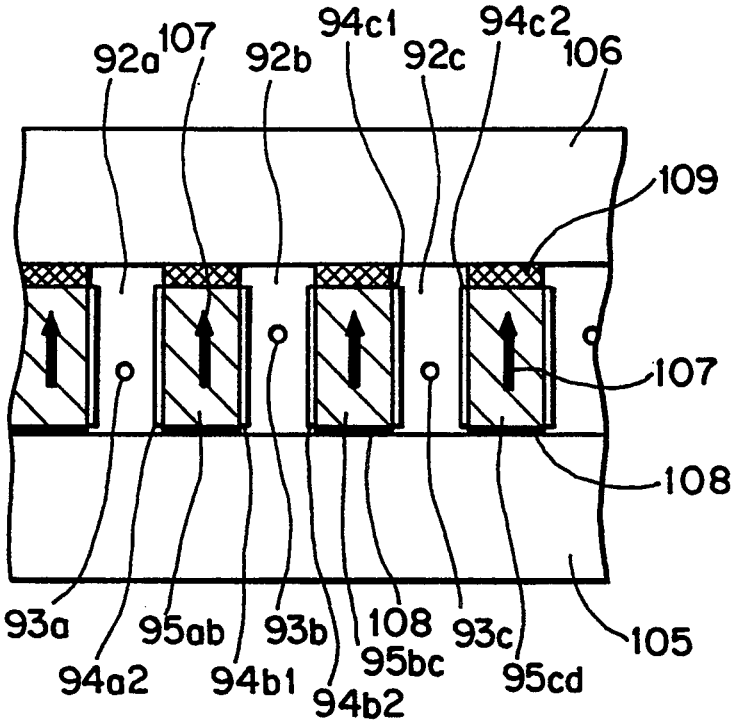
FIG. 9(a) PRIOR ART
FIG. 9(*a*) is a partial sectional view of the conventional shearing mode type ink jet head of FIG. 7.
Figure 9B:
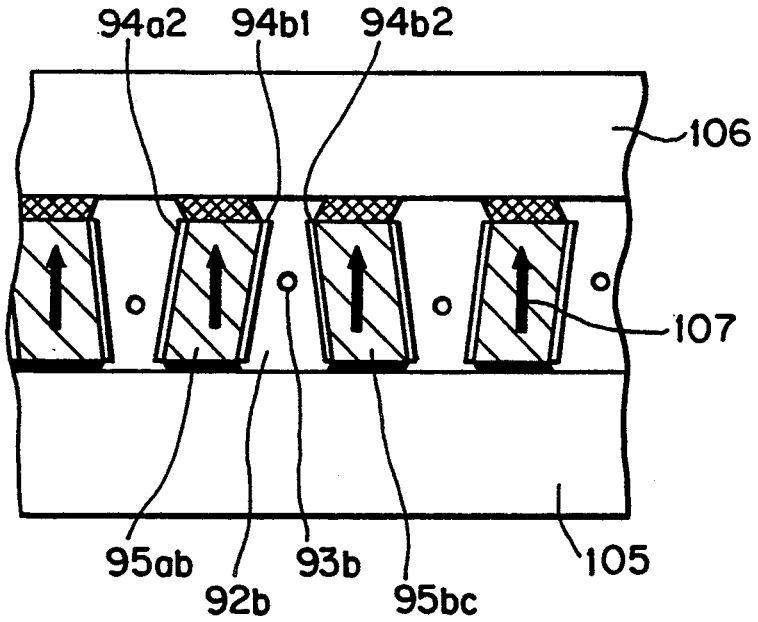
FIG. 9(b) PRIOR ART
Figure 10:
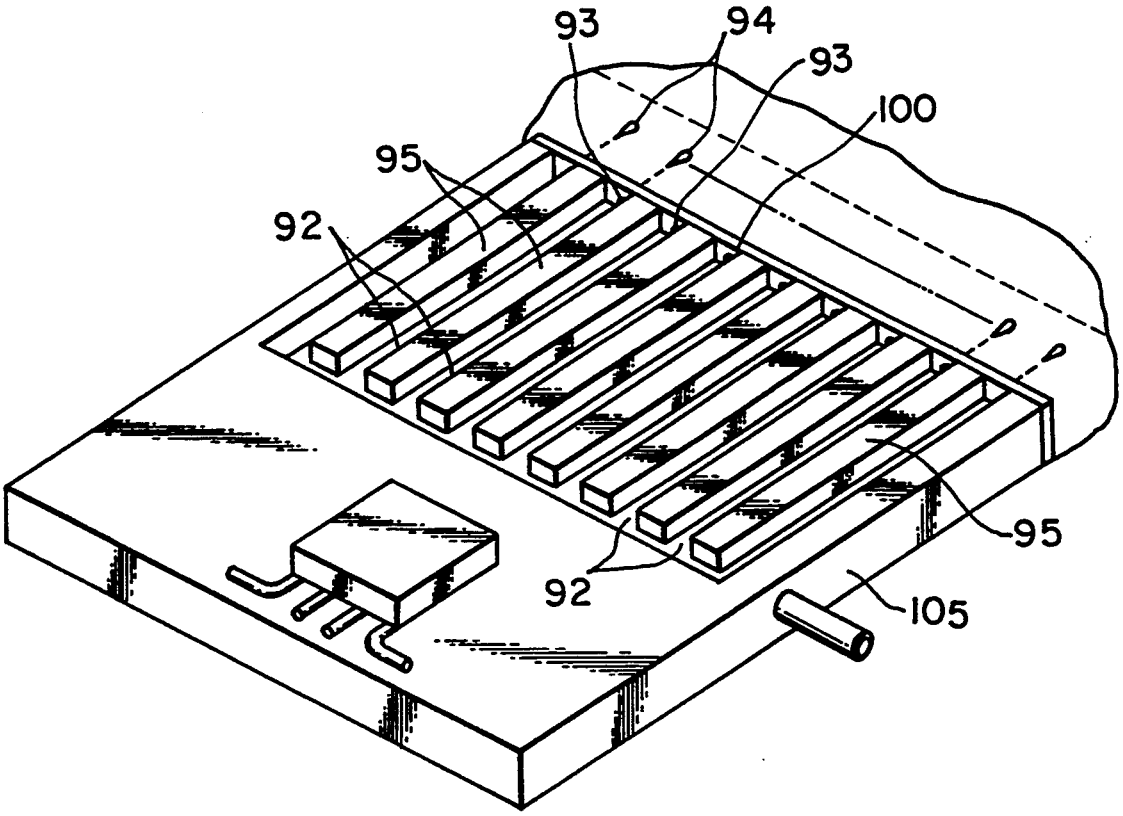
FIG.10 PRIOR ART
FIG. 10 is a perspective view of a portion of the conventional shearing mode type ink jet head of FIG. 7.

Because the jetting pressure applied to the ink contained in the active slots 3*a*–3*f* can be made equal by applying equal voltages to the various barriers as described above, the quality of printing provided by the embodiment shown in FIG. 1 is superior to that provided by the conventional ink jet head shown in FIGS. 7, 9 and 10.

Figure 3:
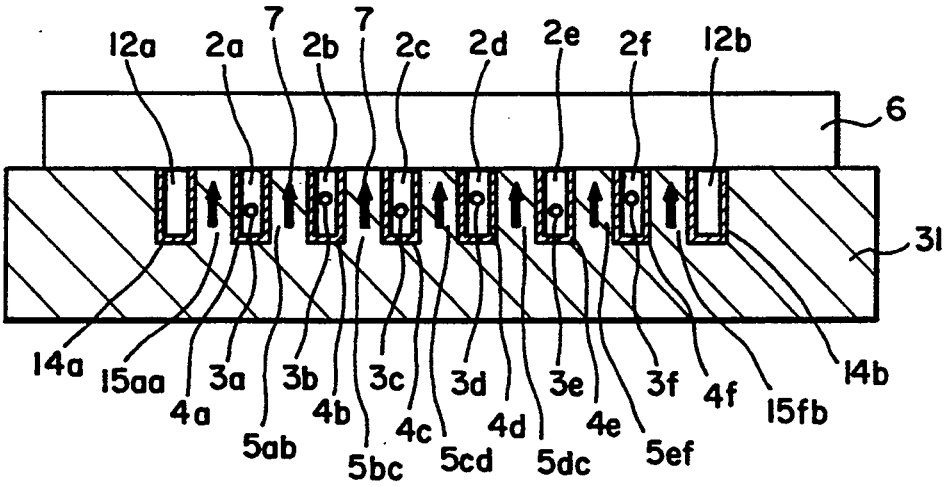
FIG. 3 is a sectional view of a shearing mode type ink jet head according to a second embodiment of the present invention.

FIG. 3 shows a sectional view of a second embodiment according to the present invention, which represents an alternative construction to that shown in FIG. 1. In the embodiment of FIG. 3, rather than providing a plurality of active barriers and dummy barriers which are bonded to the base with an adhesive layer, a base 31 is formed of a piezoelectric material and is integrally formed with the active barriers 5*ab*–5*ef* and the dummy barriers 15*aa* and 15*fb*.

Furthermore, the second embodiment shown in FIG. 3 differs from the first embodiment shown in FIG. 1 in that the electrodes 4*a*–4*f* and 14*a*, 14*b* are each mounted as a continuous electrode along the two side walls and bottom surface of each of the slots 2*a*–2*f* and 12*a*, 12*b*, respectively. More specifically, instead of having individual electrodes mounted on each opposing side wall of each active slot 2*a*, 2*f*, as well as the one side wall of the dummy slots 12*a*, 12*b* formed by the dummy barriers, the embodiment of FIG. 3 utilizes active electrodes 4*a*–4*f* which completely line the side walls and bottom surface of each of the slots 2*a*–2*f*, respectively, as well as electrodes 14*a*–14*b* which continuously line the side walls and bottom surface of each of the dummy slots 12*a*, 12*b*. This modification is possible because, in most cases, the two electrodes (e.g. 4*a*1 and 4*a*2) on opposing sides of a slot (e.g. 2*a*) in FIG. 1 have the same electric potential.

The fact that the barriers 5*ab*–5*ef* and 15*aa*, 15*fb* of the embodiment shown in FIG. 3 are formed integrally with the piezoelectric base 31 provides an added stiffness to the barriers over and above that provided by the adhesive layer 8 in the embodiment of FIG. 1. Such increased stiffness has become almost essential for a print head in order to obtain a high resolution of 300 dots per inch which has become the standard. That is, with the integrally formed barriers and base of the FIG. 3 embodiment, the stress and inevitable deformation of the adhesive layer 8 is eliminated.

In this second embodiment, the width of each of the barriers is preferably approximately 40 μm, and the pitch of the barriers (i.e. space between barriers) is preferably about 80 μm. Although in the FIG. 3 embodiment it is unnecessary to provide the elastic bonding material 9 as provided in the FIG. 1 embodiment because of the fact that the upper ends of the barriers can slide relative to the lid 6, such elastic material 9 can be provided in the second embodiment. If it is provided, however, it is preferably limited to 10 μm in thickness.

It should be noted that, although the FIG. 3 embodiment has been shown as utilizing both the integral barrier/base combination and the undivided electrodes, the integral barrier/base combination can be utilized with electrodes such as those present in the embodiment of FIG. 1.

The utilization of this integral barrier/base combination allows for the elimination of the adhesive layer 8 utilized in the embodiment of FIG. 1. This is advantageous for the following reasons.

Bonding of the piezoelectric materials with the adhesive layer 8 must be performed below the Curie temperature (normally below 150° C.) so as to maintain polarization of the barriers. Thus, it is necessary to use a high polymeric material such as an epoxy resin. However, the use of such epoxy resin results in a relatively thick adhesive layer.

The use of such relatively thick layers of high polymeric adhesive is disadvantageous in that (1) such thick adhesive layers are more subject to deformation (see FIG. 9(*b*)), thereby working to prevent the reduction in cross sectional area of the slots when it is desired to cause jetting of the ink through the nozzle holes; and (2) such high polymeric adhesive layers do not provide sufficiently high stiffness for actions of the ink jet head which are repeated at high speed. The desired stiffness of the barriers is affected by the hardness of the adhesive layer 8, but is not affected by the elastic material 9. Accordingly, the use of such relatively thick high polymeric adhesive layers may result in the lowering of the ink jet force and the frequency of the operation, which will likely adversely affect the stability and speed of printing of the printer.

Figure 4:
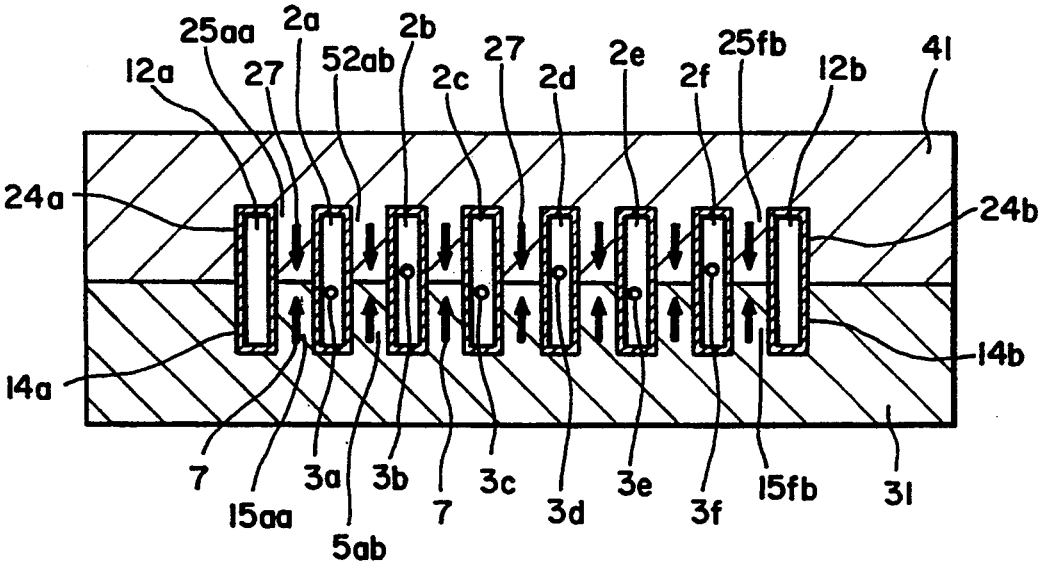
FIG. 4 is a sectional view of a shearing mode type ink jet head according to a third embodiment of the present invention.

A further alternative to the embodiment of FIG. 1 is shown in FIG. 4 in connection with a third embodiment of the present invention. This third embodiment is identical to that of FIG. 3, except that, rather than utilizing an integrated barrier/base combination 31 and a lid 6, this third embodiment utilizes a lower integrated barrier/base combination 31 and an upper integrated barrier/base combination 41. The upper base 41 is formed so as to include slots which align with those of the lower base 31.

As shown in FIG. 4, the nozzle holes 3*a*–3*f* can be located in vertical positions of the ink slots 2*a*–2*f* corresponding to either the upper base 41 or the lower base 31. The barriers 25*ab*–25*ef* and 25*aa*, 25*fb* formed integrally with the base 41 are polarized in a direction opposite to the direction in which the barriers 5*ab*–5*ef* and 15*aa*, 15*fb* of the lower base 31 are polarized, as shown by arrows 7 and 27 in FIG. 4.

The bases 31 and 41 are bonded together such that the barriers and slots of the upper and lower bases align with each other. By using two such piezoelectric material bases 31, 41, the driving force for jetting the ink from the nozzle holes 3*a*–3*f* can be increased relative to that which can be provided by the embodiment of FIG. 3.

Figure 5:
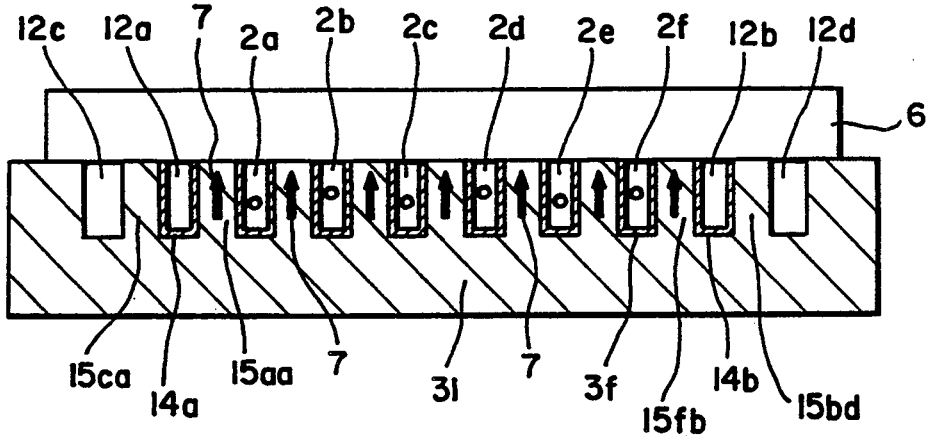
FIG. 5 is a sectional view of a shearing mode type ink jet head according to a fourth embodiment of the present invention.

Another alternative to the first embodiment shown in FIG. 1 is a fourth embodiment according to the present invention, which is shown in FIG. 5. This fourth embodiment is substantially identical to the embodiment shown in FIG. 3, except that in this fourth embodiment, an additional pair of dummy slots 12*c*, 12*d* is provided outwardly of the dummy slots 12*a*, 12*b*.

When only the one pair of dummy slots 12*a*, 12*b* are utilized as in the second embodiment (FIG. 3), because the outermost wall of each of the dummy slots 12*a*, 12*b* is formed by the base 1 which is stiffer than the barriers, when ink is filled into the dummy slots 12*a*, 12*b*, the dummy barriers 15*aa* and 15*fb* are faced with a more rigid force when flexing outwardly than when flexing inwardly, such that some non-uniformity of ink jetting may occur. Utilization of the additional dummy slots 12*c*, 12*d* in the fourth embodiment will obviate this problem.

Because the additional dummy slots 12*c*, 12*d* are used only as mechanical buffers, it is unnecessary to mount electrodes on the walls of the dummy slots 12*c*, 12*d*, and it is also unnecessary to polarize the additional dummy barriers 15*ca* and 15*bd* formed outwardly of the first dummy barriers 15*aa* and 15*fb*. However, if, for manufacturing purposes it is more efficient to provide electrodes on the walls of the additional dummy slots 12*c*, 12*d* and/or to polarized the dummy barriers 15*ca*, 15*bd*, such will not reduce the performance of the ink jet head of this fourth embodiment.

As described in connection with the dummy slots 12*a*, 12*b* of the first embodiment, small holes which are not utilized as nozzles holes may be formed in the nozzle plate at the end of the additional dummy slots 12*c*, 12*d*. In addition, it should be apparent that three or more pairs of dummy slots can be formed outwardly of the active slots.

Figure 6:
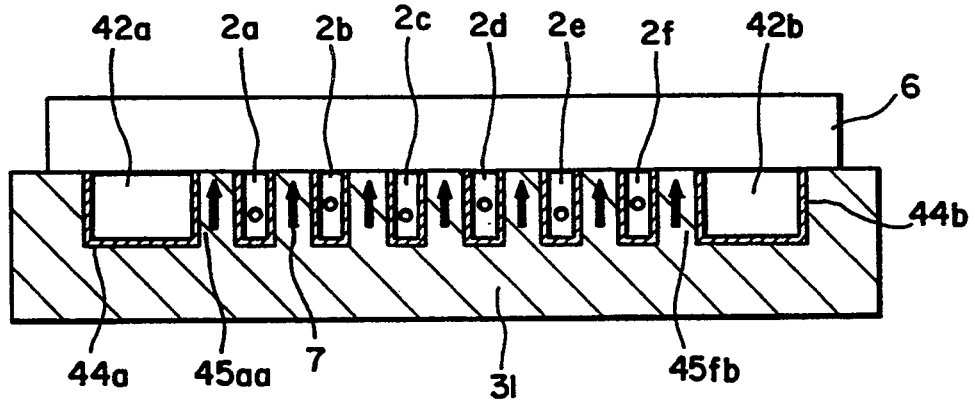
FIG. 6 is a sectional view of a shearing mode type ink jet head according to a fifth embodiment of the present invention.

A still further alternative to the first embodiment shown in FIG. 1 is a fifth embodiment which is shown in FIG. 6. This fifth embodiment is substantially identical to the second embodiment shown in FIG. 3, except that in this fifth embodiment, the dummy slots 42*a*, 42*b* formed outwardly of dummy barriers 45*aa* and 45*fb* are formed with larger cross-sectional areas than are the active slots 2*a*–2*f*. This formation of the dummy slots 42*a*, 42*b* with larger cross-sectional areas provides the same advantage as does the provision of two pairs of dummy slots as described above in connection with the fourth embodiment shown in FIG. 5. As shown in FIG. 6, dummy electrodes 44*a*, 44*b* are provided continuously along the walls and bottom surface of the dummy slots 42*a*, 42*b*.

A sixth embodiment of the present invention will now be described with reference to FIGS. 11 and 12. This embodiment is concerned with preventing the breakage of the ends of barriers 205 during the manufacturing process as was described above in connection with the ink jet head disclosed in Japanese patent application laid-open No. 252750/1988 and shown in FIGS. 7–10 and 18.

In this sixth embodiment, the ink jet head includes an insulating base 201, a plurality of barriers 205 formed of piezoelectric material and bonded to the insulating base 201 in parallel with one another and at equal intervals, in such a manner as to form narrow elongated slots 202 which define ink chambers and flow paths. Each of these slots 202 is connected at one end to a common ink reservoir 207 and is closed at the other end by a side plate 209. An upper plate 208 is provided to cover the slots 202 and ink reservoir 207, and is formed with a plurality of nozzle holes 203 which are aligned with the plurality of slots 202, respectively.

Figure 12:
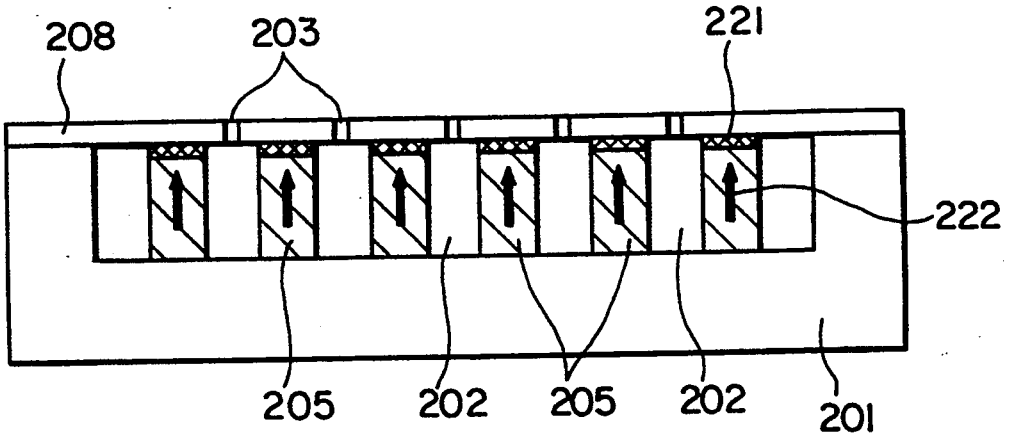
FIG. 12 is a sectional view taken along the line 12—12 of FIG. 11.

Each of the barriers 205 is polarized in a like direction as shown by arrows 222 in FIG. 12, and, although omitted from the drawing figures for purposes of clarity, electrodes are formed on the walls of the barriers in one of the two ways described above in connection with the first five embodiments. Each of the barriers 205 is preferably formed of PZT and has a width of approximately 100 μm and a height of approximately 150 μm. The base 201 is preferably of alumina and the barriers 205 are bonded thereto by an adhesive layer of epoxy resin, in such a manner as to have a pitch of 200 μm. The electrodes are preferably formed of 0.8 μm thick laminating film formed by metalizing chromium and gold. The upper plate 208 is preferably formed of plastic, with the nozzle holes 203 therein having a diameter of approximately 35 μm. The plastic upper plate 208 is preferably bonded to the barriers 205 with an elastic material 221 of silicone resin.

By forming the nozzle holes 203 in the upper plate 208 rather than in the side plate 209, significantly less precision is required to mount the side plate 209. If an end of one of the barriers 205 is broken during mounting of the side plate 209, the broken part may be filled with an adhesive. This can not be readily accomplished with the conventional construction wherein the nozzle holes are formed in the side plate 209, because repair of the broken barrier ends is very difficult without adversely affecting the precision nozzle holes formed in the nozzle plate. In addition, with the conventional nozzle plate mounted at the ends of the slots, neighboring nozzle holes may be fluidically connected if one of the barriers is broken near the end thereof, such that the ink pressure just inside the nozzle hole is reduced and the ink jetting becomes less reliable due to a reduced ink jetting volume and speed.

Figure 11:
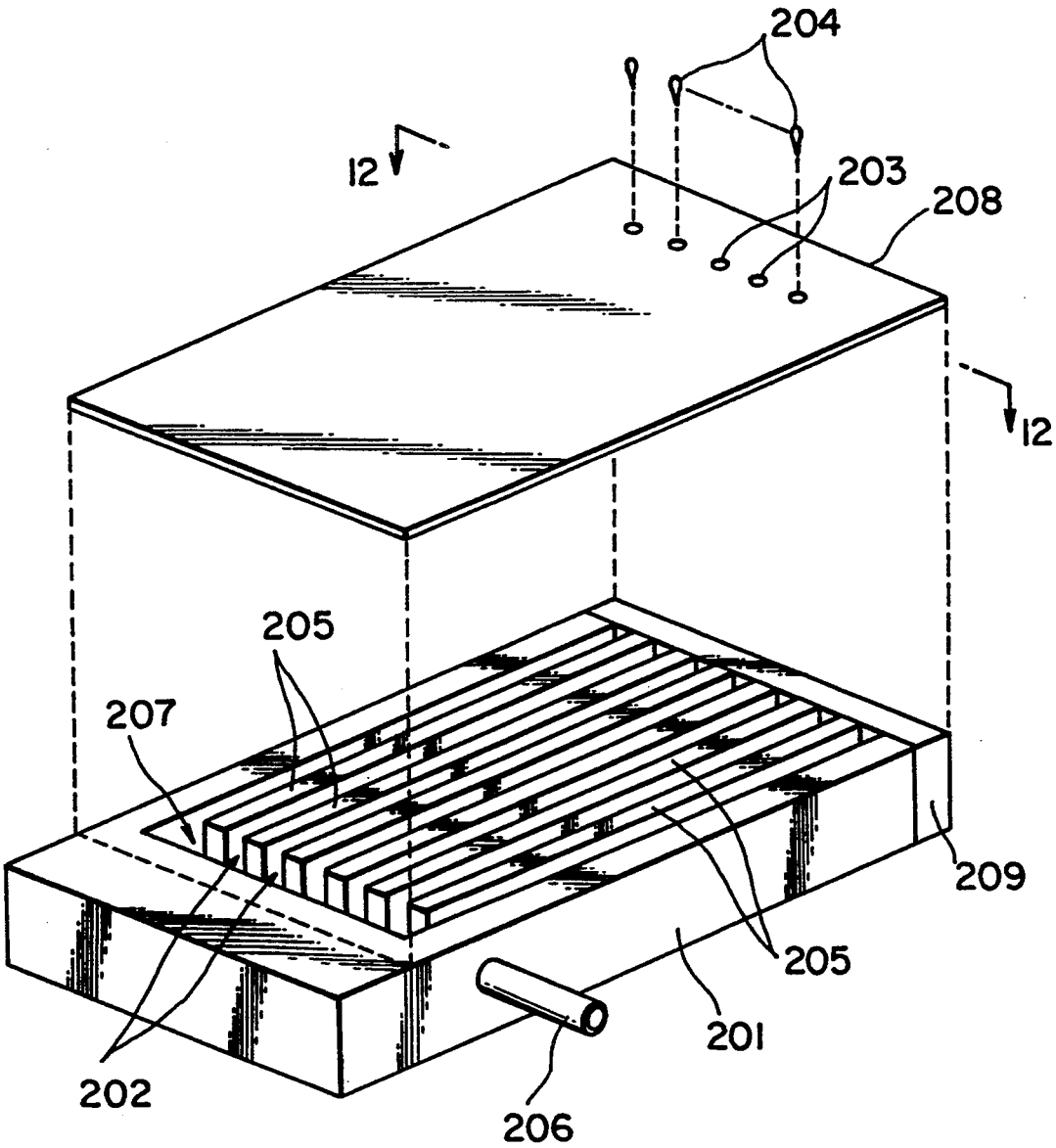
FIG. 11 is a perspective view of an ink jet head according to a sixth embodiment of the present invention.

Although the plastic upper plate 208 shown in FIG. 11 is illustrated as being a single plate, this upper plate 208 can alternatively be formed as two separate parts, one part including the nozzle holes 203 therein and the other part acting to cover the ink reservoir 207.

Figure 13:
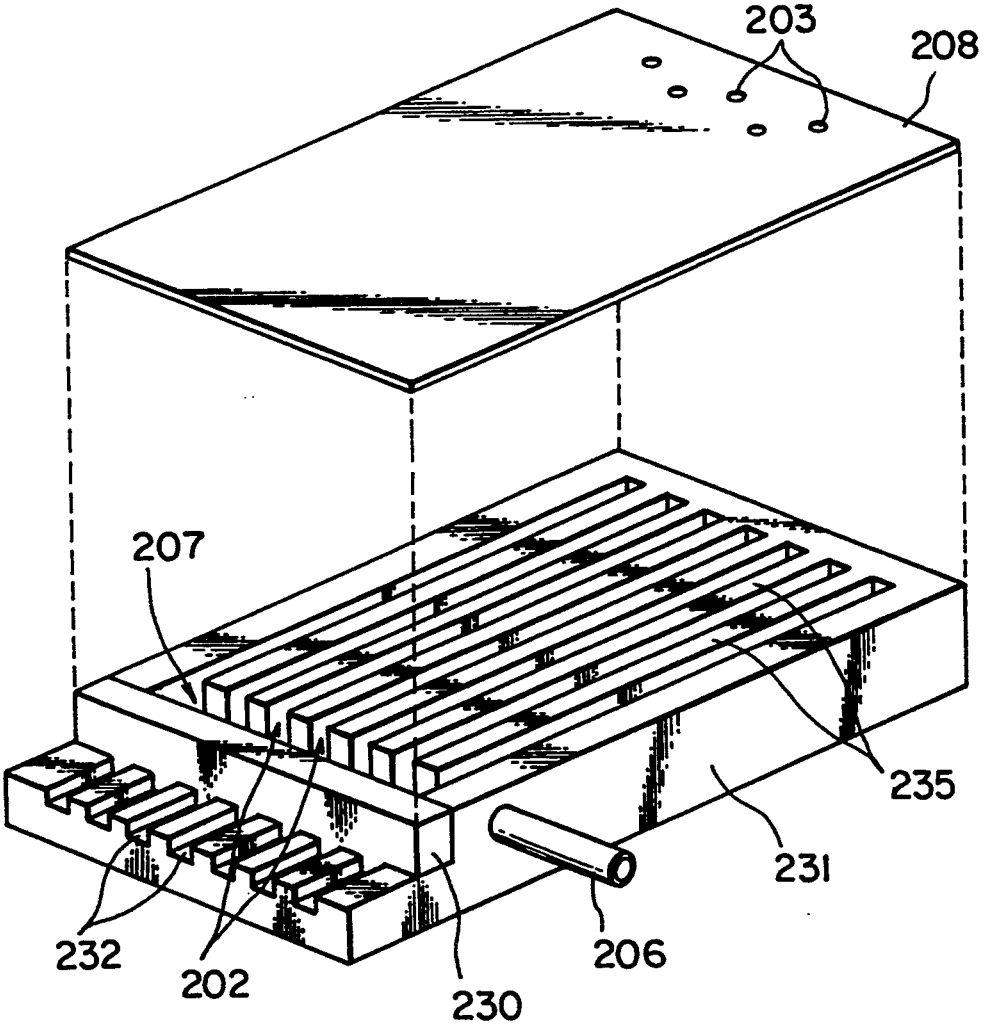
FIG. 13 is a perspective view of an ink let head according to a seventh embodiment of the present invention.

A seventh embodiment of the present invention is shown in FIG. 13 and represents an alternative to the sixth embodiment shown in FIGS. 11 and 12.

This seventh embodiment shown in FIG. 13 is similar to the embodiment shown in FIGS. 11 and 12, except that in this seventh embodiment, the plurality of barriers 235 are formed integrally with the insulating base 231, such that no adhesive layer is necessary to bond the barriers 235 to the base 231. The slots 202 formed between the barriers 235, respectively, may be formed by a cutting process beginning at one end of a plate of piezoelectric material and stopping just before the opposite end thereof in order that such opposite end of the piezoelectric plate can operate to close the first ends of the slots 202. In performing the cutting operation, shallow slots 232 may be formed in the end of the piezoelectric plate at which the cutting operation is begun. The shallow slots 232 can be used for connecting electrodes in the slots 202 with outer electrodes, by mounting electrodes in the shallow slots and connecting them to the electrodes in the slots 202. An end plate 230 is mounted at the end of the shallow slots so as to define an ink reservoir 207 and prevent outflow of the ink.

As shown in FIG. 13, the positions of the nozzle holes 203 in the upper plate 208 can be selected according to the needs of the particular situation.

With respect to polarization of the barriers 235, as these barriers 235 are to be polarized in a single direction, the entire base 231 may be polarized as a whole.

Figure 14:
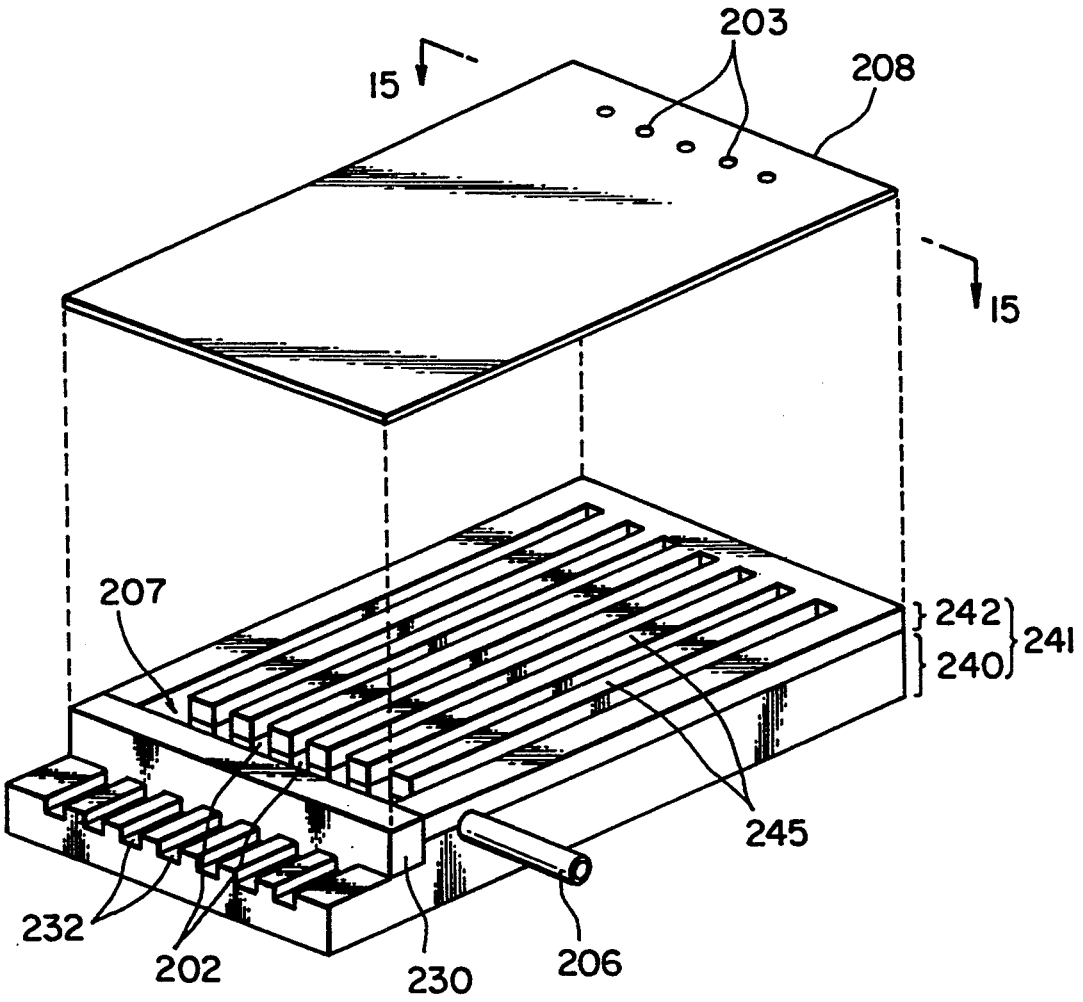
FIG. 14 is a perspective view of an ink jet head according to an eighth embodiment of the present invention.
Figure 15:
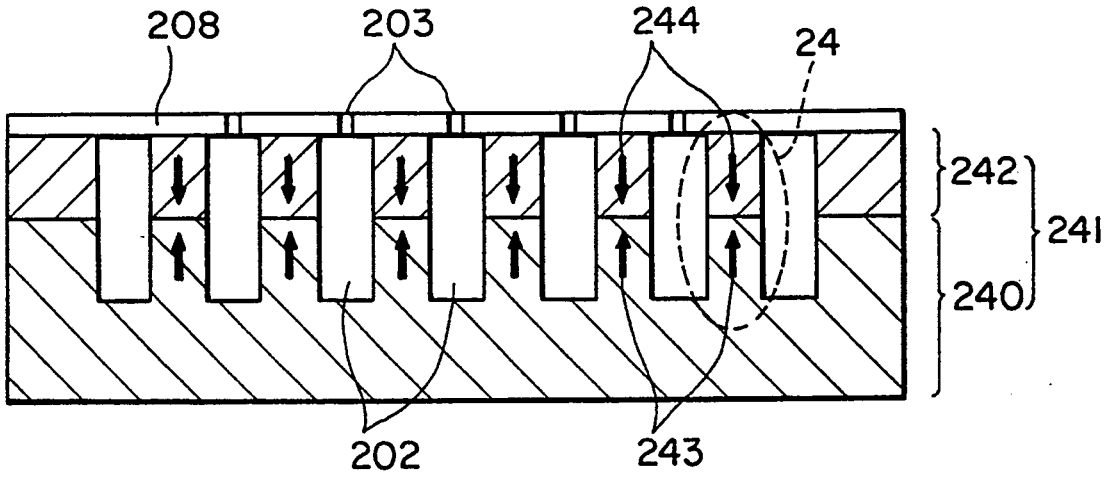
FIG. 15 is a sectional view taken along the line 15—15 of FIG. 14.

An eighth embodiment of the present invention is shown in FIGS. 14 and 15, and represent another alternative to the sixth embodiment of the present invention.

The construction of this embodiment of the invention similar to that shown in FIG. 13, except that in this eighth embodiment, the base 241 is formed of two piezoelectric material base portions 240 and 242. These bases 240 and 242 are polarized in opposite direction as indicated by arrows 243 and 244 in FIG. 15, and are joined by an adhesive.

With this construction, the barriers 245 can be deflected into a bow shape in the same manner as can the barriers shown in FIG. 4.

Figure 16:
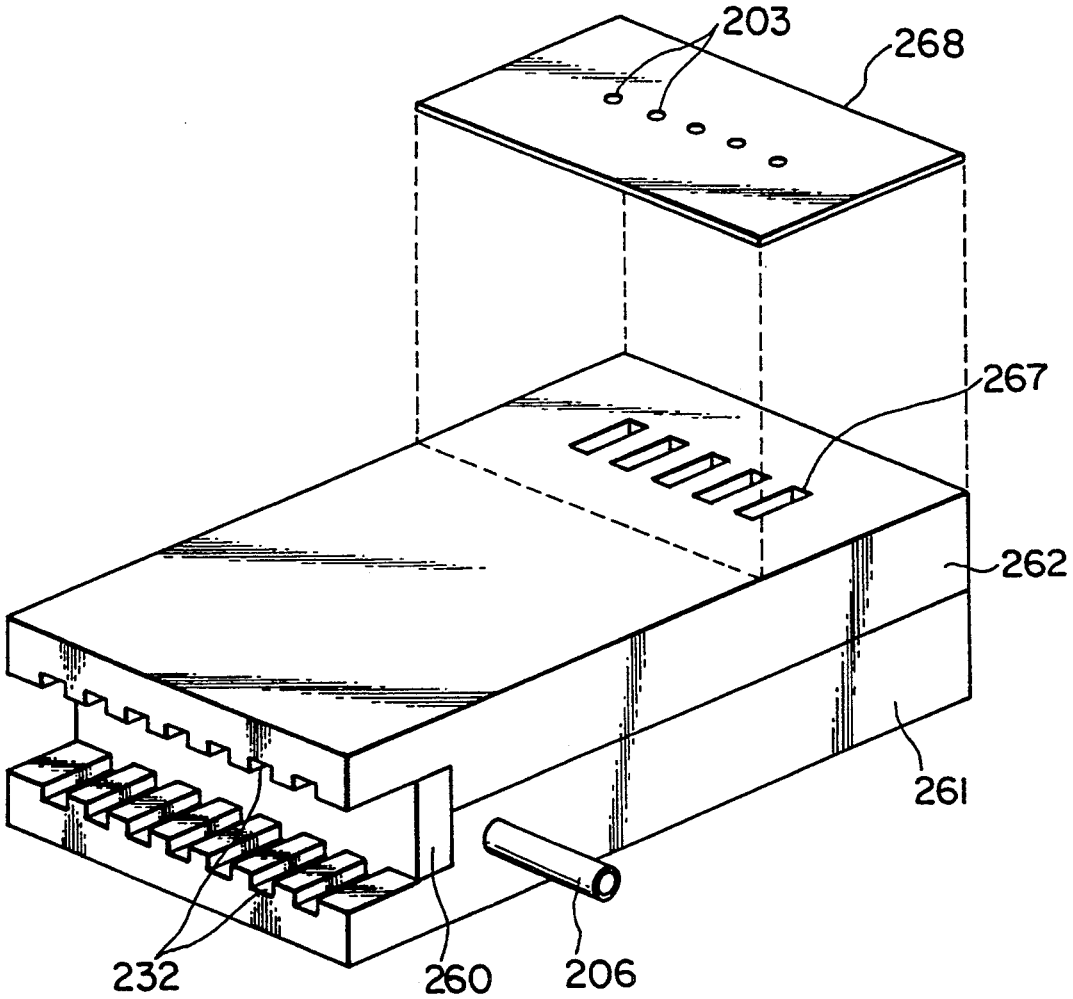
FIG. 16 is a perspective view of an ink jet head according to a ninth embodiment of the present invention.

A ninth embodiment of the present invention is shown in FIG. 16 and represents a further alternative to the sixth embodiment shown in FIG. 11.

In this ninth embodiment, two piezoelectric bases 261, 262 are provided in a manner similar to the embodiment of FIGS. 14 and 15, wherein the polarization of each of the bases is in opposite directions in the same manner as shown in FIG. 15.

Both of the bases 261 and 262 are preferably formed by a cutting process in the same manner as the base 231 shown in FIG. 13, except that in the upper base 262 of this ninth embodiment, it is necessary to form guiding holes 267 in alignment with the slots and with the nozzle holes 203 formed in a nozzle plate 268 mounted on the base 262.

Figure 17:
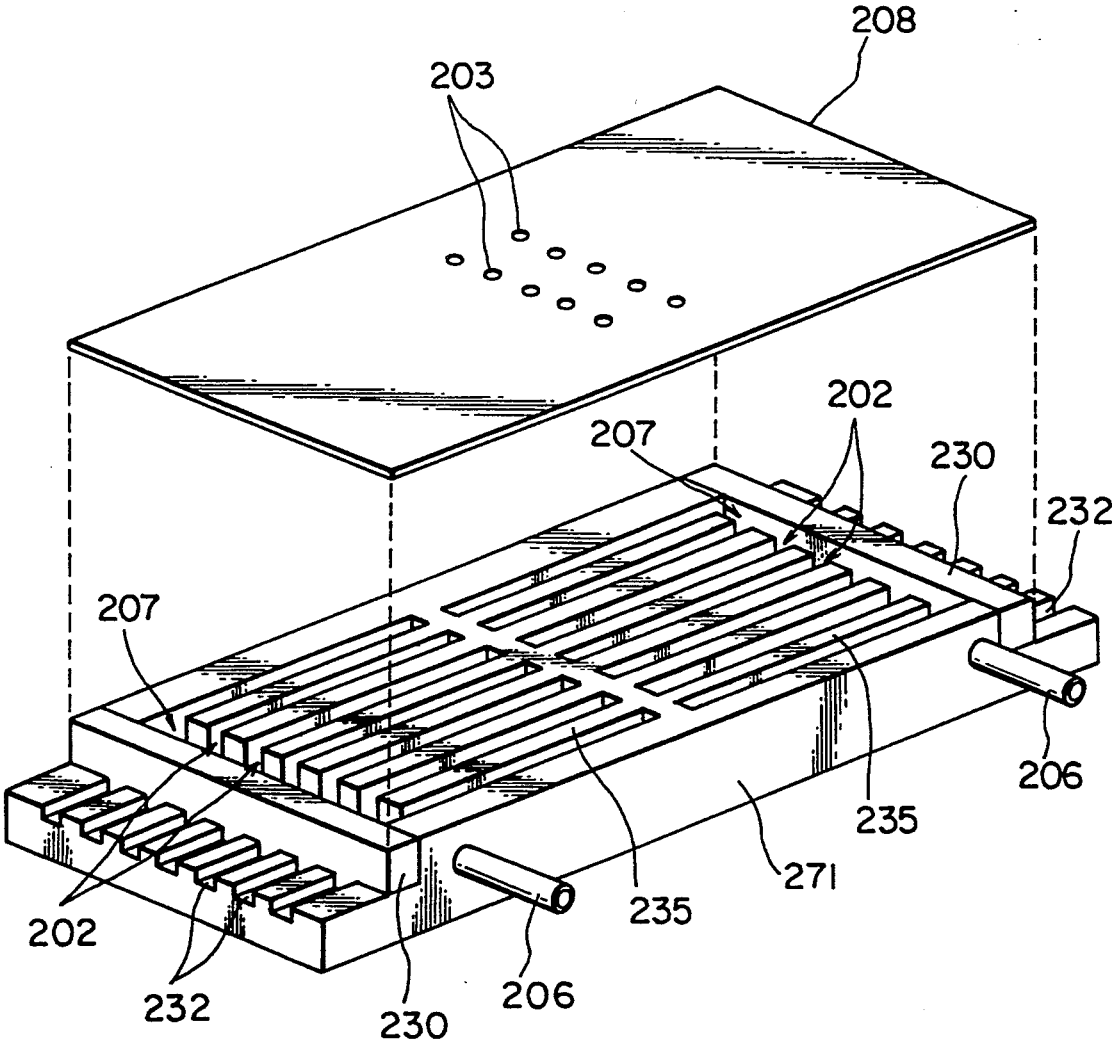
FIG. 17 is a perspective view of an ink jet head according to a tenth embodiment of the present invention.

A tenth embodiment of embodiment of the present invention is shown in FIG. 17 and represents a further alternative to the sixth embodiment shown in FIG. 11. This tenth embodiment includes a base 271 which has two ends, each being formed in the same manner as the base 231 shown in FIG. 13. Two rows of nozzle holes 203 are formed in the nozzle plate 208, such that a double-printing density may be obtained.

It is noted that the nozzle holes 203, and thus the slots 202, should be staggered by a half pitch, in order to utilize the nozzle holes 203 effectively.

In these various alternative embodiments of the present invention, the driving principle, for causing deflection of the various barriers to reduce the cross-sectional area of the slots and cause ink to be jetted through nozzle holes, is substantially the same for each of the various alternatives. As depicted in FIGS. 11, 13, 14, 16 and 17, an ink supply pipe 206 may be mounted through the base in order to supply ink to the ink reservoir 207.

It is important to note that, although the various features of the embodiments of the invention have, in general, been described as being distinct to each of the individual embodiments, it will be apparent that the first through the fifth alternative embodiments can be utilized in connection with the sixth through the tenth embodiments, in order to obtain the advantages of each, as will be apparent to those of ordinary skill in the art.

While the present invention has been described with reference to the foregoing embodiments, it will be understood by those skilled in the art that various changes and modifications may be made thereto which fall within the scope of the appended claims.

What is claimed is:

1. A shearing mode ink jet head comprising:

a base having an upper surface and a pair of upwardly projecting peripheral side walls;

a plurality of linearly spaced apart elongated barriers projecting upwardly from said upper surface of said base to form a plurality of elongated active slots along said upper surface of said base between adjacent ones of said elongated barriers, each of said active slots being defined between two of said elongated barriers, and each adjacent pair of said active slots having one of said elongated barriers as a common side wall, a dummy slot being formed outside of each outermost one of said plurality of active slots between one of said elongated barriers and one of said upwardly projecting peripheral side walls;

a common ink reservoir in communication with each of said active slots;

means, comprising electrodes mounted on opposing side walls of each of said elongated barriers which forms a side wall of one of said active slots, for selectively applying voltage to particular ones of said barriers and causing lateral displacement of said particular ones of said barriers, in order to compress ink contained in the ones of said active slots formed between said particular ones of said barriers; and means, comprising nozzle holes communicating respectively with said active slots, for controllably dispensing ink contained in said active slots formed between said particular ones of said barriers when said voltage applying means operates to compress the ink contained in said ones of said active slots formed between said particular ones of said barriers, said dummy slots being devoid of nozzle holes so as to prevent ink from being dispensed from said dummy slots.

2. A shearing mode ink jet head as recited in claim 1, wherein said common ink reservoir is in communication with a first end of each of said active slots; and said nozzle holes are respectively in communication with a second end of each of said active slots.

3. A shearing mode ink jet head as recited in claim 2, wherein said barriers are formed of a piezoelectric material.

4. A shearing mode ink jet head as recited in claim 3, wherein a plurality of dummy slots are formed outside of each of said outermost active slots between one of said elongated barriers and one of said upwardly projecting peripheral side walls.

5. A shearing mode ink jet head as recited in claim 1, wherein said barriers are formed cf a piezoelectric material.

6. A shearing mode ink jet head as recited in claim 1, wherein a plurality of dummy slots are formed outside of each of said outermost active slots between one of said elongated barriers and one of said upwardly projecting peripheral side walls.

7. A shearing mode ink jet head as recited in claim 1, wherein each of said dummy slots has a cross-sectional area greater than a cross-sectional area of each of said active slots,

8. A shearing mode ink jet head as recited in claim 1, wherein said nozzle holes are formed in a nozzle plate mounted at one end of said base so as to substantially close an end of each of said active slots.

9. A shearing mode ink jet head as recited in claim 1, wherein each of said barriers is formed separate from said base and is adhered to said base.

10. A shearing mode ink jet head as recited in claim 1, wherein each of said barriers is formed integrally with said base.

11. A shearing mode ink jet head as recited in claim 1, further comprising a lid mounted to said base above said barriers; and wherein said lid is bonded to an upper surface of each of said barriers by an elastic bonding material.

12. A shearing mode ink jet head as recited in claim 1, further comprising a lid mounted to said base above said barriers, said nozzle holes being formed in said lid in alignment with said active slots, respectively.

13. An ink jet head as recited in claim 12, wherein said barriers are formed of a piezoelectric material.

14. An ink jet head as recited in claim 12, wherein each of said barriers is formed integrally with said base.

15. An ink jet head as recited in claim 12, wherein each of said barriers is formed separate from said base and is adhered to said base.

16. An ink jet head as recited in claim 12, wherein said plurality of active slots defines a first set of slots;

a second set of slots, substantially identical to said first set of slots, is formed along said base, said second set of slots and said first set of slots having respective first ends adjacent one another and having respective second ends spaced from one another; and one of said nozzle holes is respectively aligned with each of said slots of both said first and second sets of slots.

17. An ink jet head comprising:

a lower base having an upper surface and a pair of upwardly projecting lower peripheral side walls;

a plurality of linearly spaced apart elongated lower barriers having upper surfaces and projecting upwardly from said upper surface of said lower base to form a plurality of elongated lower active slots along said upper surface of said lower base between adjacent ones of said elongated lower barriers, each of said lower active slots being defined between two of said lower elongated barriers, and each adjacent pair of said lower active slots having one of said lower elongated barriers as a common side wall, a lower dummy slot being formed outside of each outermost one of said plurality of lower active slots between one of said elongated lower barriers and one of said upwardly projecting lower peripheral side walls;

an upper base having a lower surface and a pair of downwardly projecting upper peripheral side walls;

a plurality of spaced apart elongated upper barriers having lower surfaces and projecting downwardly from said lower surface of said upper base to form a plurality of elongated upper active slots along said lower surface of said upper base between adjacent ones of said elongated upper barriers, each of said upper active slots being defined between two of said upper elongated barriers, and each adjacent pair of said upper active slots having one of said elongated upper barriers as a common side wall, an upper dummy slot being formed outside of each outermost one of said plurality of upper active slots between one of said elongated upper barriers and one of said downwardly projecting upper peripheral side walls, said lower surfaces of said upper barriers being mounted in abutment with said upper surfaces of said lower barriers, respectively, such that said upper and lower active slots together form a plurality of elongated active ink slots formed between said upper base and sad lower base, said upper and lower dummy slots together form elongated dummy ink slots formed between said upper base and said lower base, and said upper and lower barriers together form a plurality of elongated ink barriers;

means, comprising electrodes mounted on opposing side walls of each of said elongated ink barriers which forms a side wall of one of said active ink slots, for selectively applying voltage to particular ones of said ink barriers and causing lateral displacement of said particular ones of said ink barriers, in order to compress ink contained in the ones of said active ink slots formed between said particular ones of said ink barriers; and means, comprising nozzle holes communicating respectively with said active ink slots, for controllably dispensing ink contained in said active ink slots formed between said particular ones of said ink barriers when said voltage applying means operates to compress the ink contained in said ones of said active ink slots formed between said particular ones of said ink barriers, said dummy ink slots being devoid of nozzle holes so as to prevent ink from being dispensed from said dummy ink slots.

18. An ink jet head as recited in claim 17, wherein said ink barriers are formed of a piezoelectric material.

19. An ink jet head as recited in claim 17, wherein each of said upper barriers is formed separate from said upper base and is adhered to said upper base; and each of said lower barriers is formed separate from said lower base and is adhered to said lower base.

20. An ink jet head as recited in claim 17, wherein each of said upper barriers is formed integrally with said upper base; and each of said lower barriers is formed integrally with said lower base.

* * * * *